United States Patent [19]

Wicher, Jr.

[11] 4,108,521

[45] Aug. 22, 1978

[54] METHOD OF MAKING A DISPLAY PANEL AND THE ANODES THEREFOR

[75] Inventor: Daniel P. Wicher, Jr., Newton, N.J.

[73] Assignee: Burroughs Corporation, Detroit, Mich.

[21] Appl. No.: 842,735

[22] Filed: Oct. 17, 1977

Related U.S. Application Data

[63] Continuation of Ser. No. 718,795, Aug. 30, 1976, abandoned.

[51] Int. Cl.[2] ..... H01J 9/02

[52] U.S. Cl. ..... 316/17; 316/24; 29/25.16; 29/25.17

[58] Field of Search ..... 316/17, 20, 24; 29/25.15, 25.16, 25.17; 427/108

[56] References Cited

U.S. PATENT DOCUMENTS

| | | | |
|---|---|---|---|
| 2,417,967 | 3/1947 | Booe | 29/DIG. 22 |
| 3,720,452 | 3/1973 | Kupsky | 316/20 |
| 3,810,686 | 5/1974 | Coleman | 316/20 |
| 3,873,171 | 3/1975 | Miyamoto et al. | 316/20 |

OTHER PUBLICATIONS

Cold Flow-Interconnection by Gedd et al. in IBM Technical Disclosure Bulletin, vol. 10, No. 7 of Dec. 1967.

*Primary Examiner*—Richard B. Lazarus
*Attorney, Agent, or Firm*—Kevin R. Peterson; Robert A. Green; Edward J. Feeney, Jr.

[57] ABSTRACT

A display panel includes a generally flat gas-filled envelope which comprises a base plate and a face plate hermetically sealed together. The base plate carries a plurality of groups of cathode segments, and the face plate carries a transparent conductive anode for each group of cathodes. The anodes are formed by a screening process, and they comprise a matrix of cadmium and indium oxides and various other metal oxides.

6 Claims, 3 Drawing Figures

METHOD OF MAKING A DISPLAY PANEL AND THE ANODES THEREFOR

CROSS-REFERENCE TO RELATED APPLICATION

This application is a continuation of application Ser. No. 718,795; filed Aug. 30, 1976, and now abandoned.

BACKGROUND OF THE INVENTION

At the present time, gas-filled display panels for displaying characters by energizing groups of cathode segments generally include a tin oxide film on the face plate for each group of cathode segments. Generally, these anode films are made by a photo-etching process in which a face plate having one surface completely coated with tin oxide is photographically processed and etched to remove the portions of the film which are not needed to leave the desired anode films. This is an undesirable process because the starting material, the glass coated with tin oxide, is expensive because of the relatively high standard of optical properties which are required. In addition, where it is necessary to form fine, closely-spaced tin oxide anode lines, it is difficult to form such lines without leaving hair-like shorts between two functionally independent anodes or damaging the desired unetched portions. The present invention solves these problems by forming anodes by a direct process, with no auxiliary processes such as etching being required, and it also eliminates the need for expensive optical quality tin oxide-coated glass.

DESCRIPTION OF THE PREFERRED EMBODIMENTS

Figure 1:
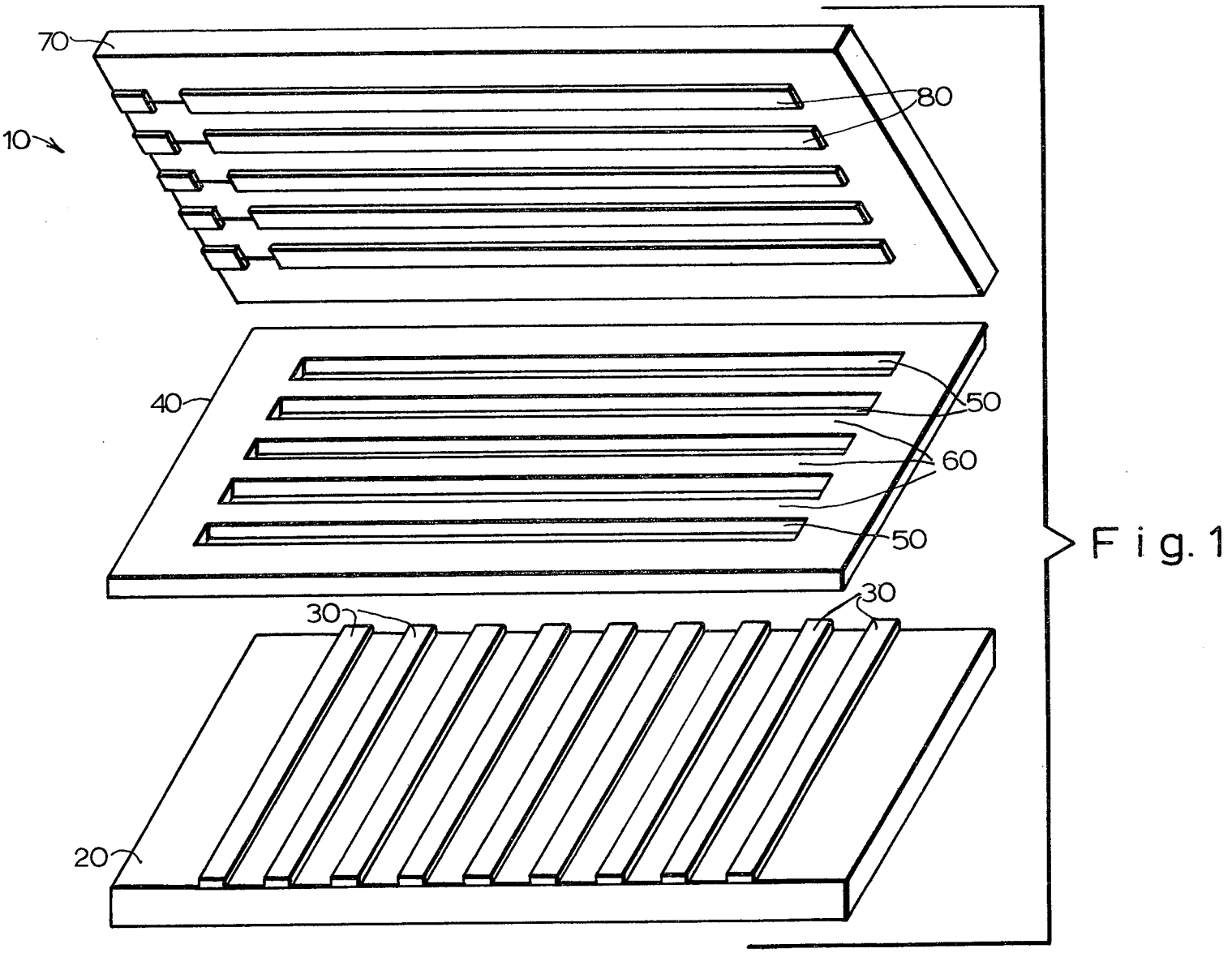
FIG. 1 is a perspective, exploded view of a display panel embodying the invention.
Figure 2:
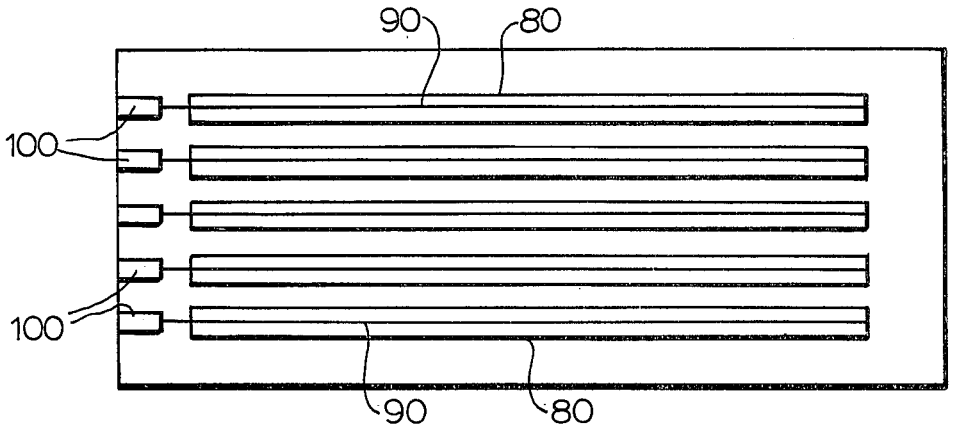
FIG. 2 is a plan view of the bottom surface of the face plate.

The principles of the invention are applicable to many types of display devices, but they are particularly useful in devices known as SELF-SCAN panels. Panels of this type are described and claimed in copending application Ser. No. 636,919, filed Dec. 2, 1975, and now U.S. Pat. No. 3,995,185 and incorporated herein by reference. Briefly, a SELF-SCAN panel 10 of the type shown in the application includes a base plate 20 on which a plurality of conductive cathode strips 30 are formed, preferably by a screening process. The cathodes are divided into individual operating areas by means of an insulating sheet 40 of an insulating, glassy material. The center sheet includes a plurality of channels 50 formed by spaced parallel walls 60, and the sheet 40 is seated on the cathodes 30 so that the channels 50 overlie rows of cathode elements. Each cathode element defines, with other electrodes to be described, an operating glow discharge ceil. The panel 10 is completed by an anode plate 70 which is the face plate or viewing plate of the panel and which carries, on its inner surface, a separate conductive transparent anode strip 80 overlying each of the channels 50 in the center sheet and each of the rows of cathode areas defined by the channels in the center sheet.

According to the invention, the anode plate 70 is formed as follows. First, conductive runs 90 for making external connections to the anodes 80 are formed by a screening process with a suitable conductive material such as silver, a mixture of silver-palladium, a mixture of silver-platinum, or the like. The conductors 90 are formed as fine horizontal parallel lines on the bottom surface of the face plate, with each line being intended to serve as a conductor for an anode strip. The conductors extend laterally to the edges of the panel face plate where they terminate in pads 100 to which external connections can be made. Next, the anodes 80 are screened on the face plate as relatively narrow strips, each of which makes electrical contact with one of the conductors 90. The anode strips 80 are positioned so that each overlies its proper row of cathode areas which are operated as priming cells or display cells. It is noted that the anode strips do not extend into the perimeter of the face plate at which the hermetic panel seal is to be formed.

Figure 3:
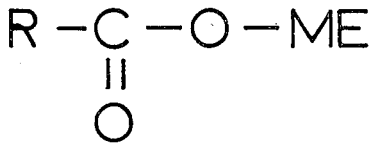
FIG. 3 is a representation of an organic molecule used in making the anodes of the panel of FIG. 1.

The preferred material for the anode strips is a mixture of cadmium and indium oxides, with the indium oxides being present at about 5% to about 15% of the total. The material used to form the anode strips is initially a cadmium-indium resinate, the resinate providing an optimum vehicle for the cadmium and indium metals. One suitable structure of the resinate is shown in FIG. 3 where R is an aromatic or aliphatic group and ME is the metal, that is, cadmium or indium which is bonded in the crystal structure. The resinate or metallo-organic mixture is used in liquid or paste form in a homogeneous single-phase true solution which can be readily screened on the face plate.

This material is available commercially from Engelhard Industries Division of East Newark, N.J. These materials have also been described in an article entitled "Electrical Applications of Thin Films Produced By Metallic Organo Deposition," by C. Y. Kuo, and given at the International Society for Hybrid Microelectronics. The material, when prepared for screening, has a viscosity of about 10,000 cps at a shear rate of 100 $S^{-1}$.

After the anode material has been screened on the face plate, it is thermally decomposed to remove all organic materials which forms a matrix of cadmium and indium oxides. Preferably, the material is decomposed in air in an oven having a flat thermal profile which peaks at 490° C. for 6 to 10 minutes. The permissible peak curing range is from 450° C. to 520° C. This heat treatment provides optimum light transmission through the anode films and optimum conductivity.

It is noted that all operations which are carried out in forming the anodes are carried out under maximally dust-free conditions.

Face plates with unusable anode films can be re-used by having the anode films removed with a 1% solution of ethylene diaminotetraacetic acid disodium salt (EDTA), leaving the conductors 90 intact. The anodes are then re-formed by screening. This represents an important economic advantage in a mass production operation.

Other base metal resinates or mixtures thereof which form transparent oxide films after air decomposition could be utilized as an anode material in gas discharge displays. These include films of MgO, $TiO_2$, $ZnO_2$, $SnO_2$, and $Sb_2O_3$. In very thin films (500° A or less), precious metal resinates such as gold, platinum, palladium and silver are also useful in an anode capacity.

After the base plate 20 and face plate 70 have been formed as described above, they are hermetically sealed together, with center sheet 40, by means of a suitable sealing material such as Pyroceram. After the desired seal has been formed, the panel is evacuated, baked out, and filled with the desired ionizable gas such as argon, neon, xenon, or the like, singly or in combination, at a suitable pressure. The evacuation and gas filling may be performed through a tubulation or in an oven at a suitable time in the process of forming the panel seal. The sealed and filled panel is then aged as required.

Other organo-metallic systems may be used in practicing the invention so long as the material can be screened and the organic vehicle can be removed substantially completely to leave a metal film which is suitably transparent.

I claim:

1. The method of making a display panel comprising the steps of forming a plurality of parallel cathode strip electrodes on an insulating base plate, forming conductive runs on a glass face plate, said runs being thin, parallel conductive lines, screening an organo-metallic substance on said face plate in a pattern of parallel lines, each line being in contact with one of said conductive runs, baking said face plate to remove organic substances therefrom and to leave the metallic portion of said substance in said pattern as transparent anode lines which are in contact with said conductive runs, assembling said base plate and face plate so that said anode lines are disposed transverse to said cathode strips, with an apertured center sheet between the base plate and face plate, said center sheet subdividing said cathode strips into separate operating areas, and hermetically sealing together the base plate and face plate to form an envelope.

2. The method defined in claim 1 and including the step of filling said envelope with an ionizable gas.

3. The method defined in claim 1, wherein said baking step is carried out in air so that the metallic portion of said substance is oxidized.

4. The method defined in claim 1 wherein said conductive runs extends through the seal between the base plate and face plate to the outside of said envelope and said anode lines do not enter said seal but remain completely within said envelope.

5. The method of making a display panel comprising the steps of forming a plurality of cathode electrodes on an insulating base plate, screening an organo-metallic substance on a glass face plate in a plurality of patterns, baking said face plate to remove organic substances therefrom and to leave the metallic portion of said substance in said patterns as transparent anodes, assembling said base plate and face plate so that each of said anodes overlies and is in operative relation with at least one of said cathode electrodes, and hermetically sealing together the base plate and face plate to form an envelope.

6. The method of making a display panel comprising the steps of forming a plurality of cathode electrodes on an insulating base plate, forming a plurality of conductive areas on a glass face plate, screening an organo-metallic substance on said face plate in a plurality of patterns, each pattern being in contact with one of said conductive areas, baking said face plate to remove organic substances therefrom and to leave the metallic portion of said substance in said patterns as transparent anode areas which are in contact with said conductive areas, assembling said base plate and face plate so that each of said anode areas overlies and is in operative relation with at least one of said cathode electrodes, and hermetically sealing together the base plate and face plate to form an envelope.

* * * * *